US005563571A

United States Patent [19]

Sobhani

[11] Patent Number: 5,563,571

[45] Date of Patent: Oct. 8, 1996

[54] VARIABLE RESISTOR MADE USING A FLEXPRINT CIRCUIT AND HAVING A ROTATABLE SUBSTRATE

[75] Inventor: Mohi Sobhani, Encino, Calif.

[73] Assignee: Hughes Electronics, Los Angeles, Calif.

[21] Appl. No.: 343,069

[22] Filed: Nov. 21, 1994

[51] Int. Cl.[6] ..... H01C 10/26

[52] U.S. Cl. ..... 338/152; 338/276; 338/211

[58] Field of Search ..... 338/211, 152, 338/160, 174, 204, 176–178, 276

[56] References Cited

U.S. PATENT DOCUMENTS

| | | | |
|---|---|---|---|
| 2,873,336 | 2/1959 | Tassara | 338/174 |
| 2,877,328 | 3/1959 | Bourns | 338/152 |
| 3,161,850 | 12/1964 | Klug | 338/174 |
| 4,511,879 | 4/1985 | Fujii | 338/160 |
| 4,647,897 | 3/1987 | Bingold et al. | 338/174 |
| 4,928,082 | 5/1990 | Yagi et al. | 338/211 |
| 5,113,172 | 5/1992 | Lang | 338/174 |
| 5,144,278 | 9/1992 | Moseley et al. | 338/178 |
| 5,264,821 | 11/1993 | Vultaggio et al. | 338/172 |

*Primary Examiner*—Teresa J. Walberg
*Assistant Examiner*—Raphael Valencia
*Attorney, Agent, or Firm*—M. E. Lachman; M. W. Sales; W. K. Denson-Low

[57] ABSTRACT

A variable resistor that employs a bumped or dimpled flexprint circuit that rotates relative to an adjacent ceramic substrate having concentric circular resistors formed with printed resistive ink. The ceramic substrate is fused or screened with the resistive ink in a circular arrangement that forms the plurality of concentric printed resistors. The flexprint circuit having bump or dimple contacts is constructed, and the contacts of the flexprint circuit are positioned facing the ceramic substrate so that contact is made between the individual resistors and contacts. As the ceramic substrate rotates relative to the contacts, the values of the resistors change to produce variable resistor values.

9 Claims, 4 Drawing Sheets

VARIABLE RESISTOR MADE USING A FLEXPRINT CIRCUIT AND HAVING A ROTATABLE SUBSTRATE

BACKGROUND OF THE INVENTION

1. Field of the Invention

The present invention relates to variable resistors, and more particularly, to low cost variable resistors made using flexprint circuits.

2. Description of Related Art

Conventional variable resistors, or potentiometers, are made using a resistor bar with moving contact points. Due to their mechanical complexity, such variable resistors, or potentiometers, are relatively expensive components. It is only possible to manufacture one potentiometer in a single device. The primary problem associated with conventional variable resistors, or potentiometers, is one of reliability due to heat generation in the resistor bar.

Therefore, it is an objective of the present invention to provide for an improved low cost variable resistor that improves upon conventional potentiometer devices.

SUMMARY OF THE INVENTION

In order to meet the above and other objectives, the present invention is a low cost variable resistor that employs a bumped or dimpled flexprint circuit that rotates relative to an adjacent ceramic substrate having concentric circular resistors formed with printed resistive ink. The ceramic substrate is fused or screened with the resistive ink in a circular arrangement that provides for a plurality of concentric printed resistors. The flexprint circuit having bump or dimple contacts is constructed, and the bump or dimple contacts of the flexprint circuit are positioned facing the ceramic substrate so that contact is made between the individual resistors and the bump or dimple contacts. As the ceramic substrate rotates relative to the bump or dimple contacts, the values of the resistors change to produce variable resistor values.

More specifically, the variable resistor comprises a ceramic substrate having a plurality of concentric circularly-shaped printed ink resistors disposed on one surface thereof. A central conductive ring is disposed at the center of the plurality of concentric conductive printed ink resistors. A conductive strip interconnects the conductive ring to one end of each of the concentric printed ink resistors. A flexprint circuit having a plurality of contacts is disposed on one surface thereof, and wherein the contacts are disposed adjacent to the printed ink resistors of the ceramic substrate. A plurality of conductive traces are disposed on an opposite surface of the flexprint circuit and are connected to the plurality of contacts. Means are provided for permitting rotation of the ceramic substrate relative to the flexprint circuit to thereby change the value of each of the printed ink resistors.

The above components are generally disposed in a housing, and a spring or other resilient device is disposed in the housing that abuts a surface of the ceramic substrate that ensures contact between the contacts and the printed ink resistors. A bearing or other rotational means is disposed between the flexprint circuit and the housing that permits rotation of the ceramic substrate relative to the contacts of the flexprint circuit.

The present invention provides for a relatively low cost, reliable variable resistor, or potentiometer, for use in analog circuits. The present invention is low cost due to the fact that it is inexpensive to print and fabricate the flexprint circuit and printed ceramic substrate when compared to conventional variable resistors. The present invention advantageously provides for a low profile, low cost, low weight, reliable variable resistor. In addition, many variable resistors may be formed in the same device using the concepts of the present invention.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which.

DESCRIPTION OF THE PREFERRED EMBODIMENTS

Figure 1:
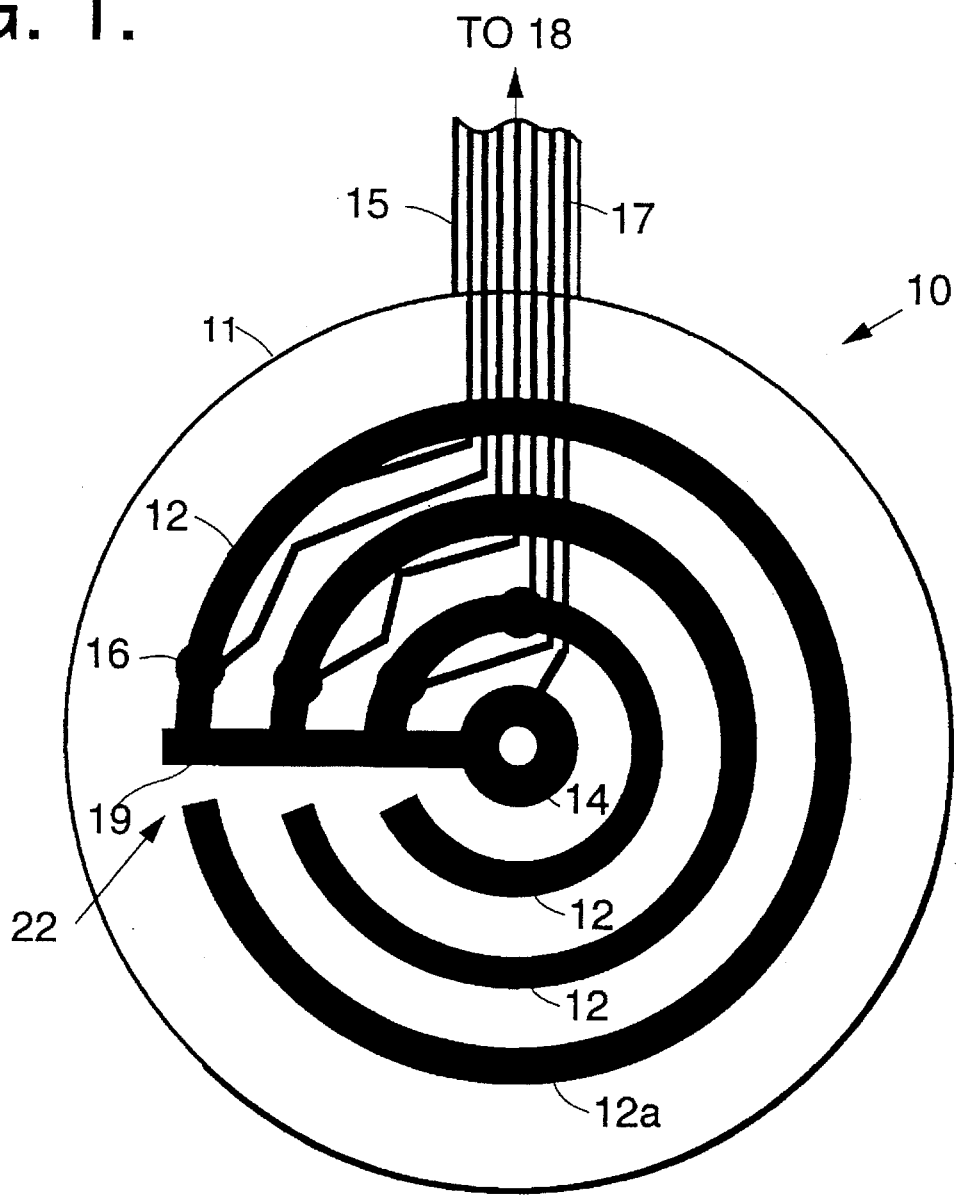
FIG. 1 is a top view of primary operative components of a variable resistor in accordance with the principles of the present invention.

Referring to the drawing figures, FIG. 1 illustrates a top view of primary operative components of a variable resistor 10 in accordance with the principles of the present invention. The present variable resistor 10 includes a ceramic substrate 11 on which are disposed a plurality of concentric circular printed ink resistors 12. Each of the printed ink resistors 12 is printed so that it forms less than a complete circle such that there is a gap 22 formed between adjacent ends thereof, so that the printed ink resistors 12 thus are generally formed in the shape of a "C". Typically, the concentric circular printed ink resistors 12 are formed such that resistive ink **12*a* is printed approximately 350 degrees of a complete circle. The plurality of printed ink resistors 12 are disposed on one surface of the ceramic substrate 11. A central conductive ring 14 is disposed at the center of the plurality of concentric conductive printed ink resistors 12. A conductive strip 19 interconnects the conductive ring 14 to one end of each of the concentric printed ink resistors 12**.

Figure 4:
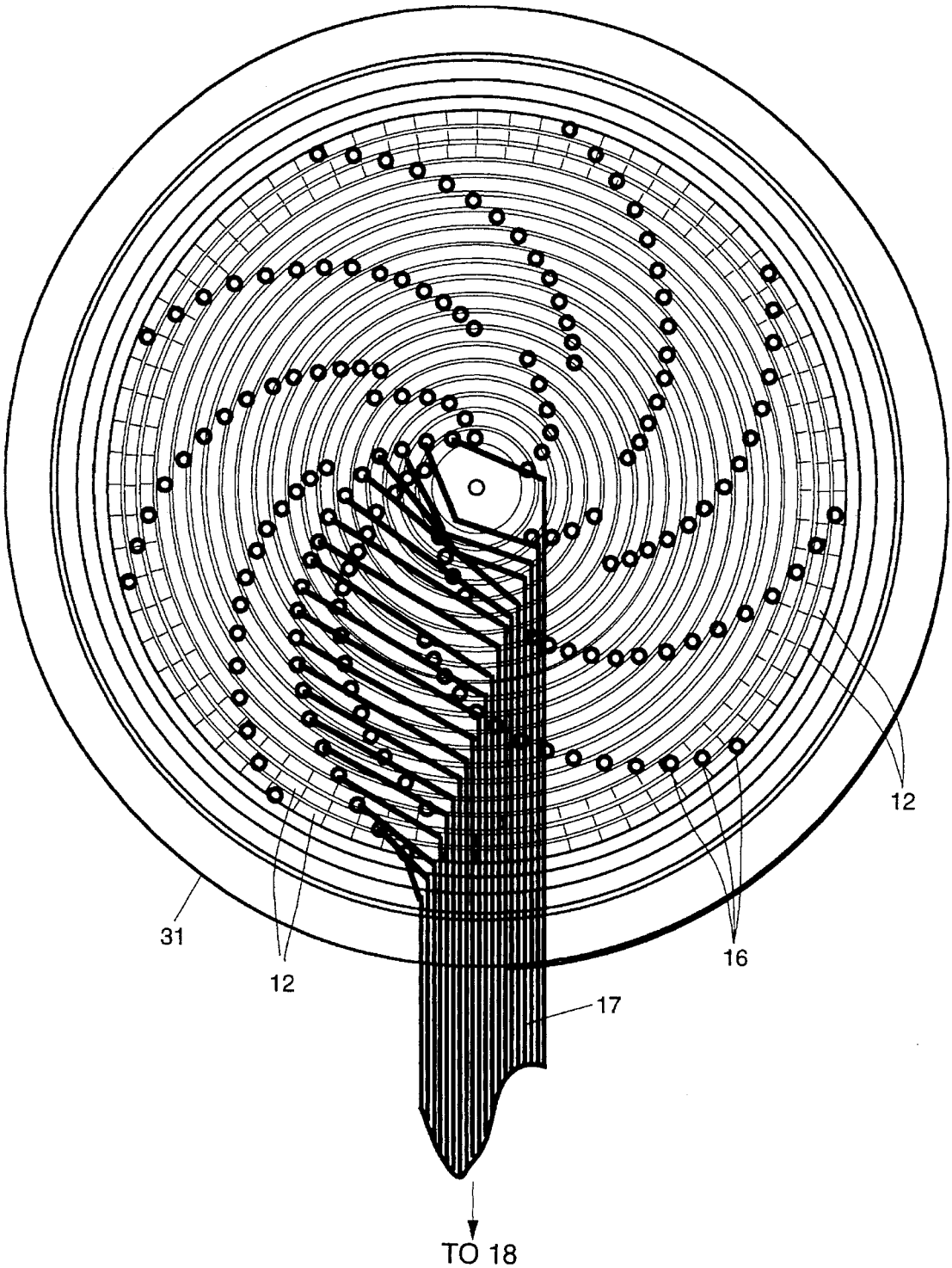
FIG. 4 illustrates details of an operative embodiment of a typical flexprint circuit that may be employed in the variable resistor.

A flexprint circuit 15, which is generally comprised of a flexible acetate material, for example, has a plurality of contacts 16, comprising bumps 16 or dimples 16, formed on a surface that is disposed adjacent to the surface of the ceramic substrate 11 on which the printed ink resistors 12 are disposed. A plurality of conductive traces 17 are disposed on an opposite surface of the flexprint circuit 15 and are connected to the plurality of bumps 16 or dimples 16 by means of a plurality of vias (not shown) in a conventional manner that are disposed through the flexprint circuit 15. The plurality of conductive traces 17 interconnect the plurality of bumps 16 or dimples 16 to external connector pads (not shown). FIG. 4 illustrates details of an operative embodiment of a typical flexprint circuit 15 that may be employed in the variable resistor 10.

Figure 2:
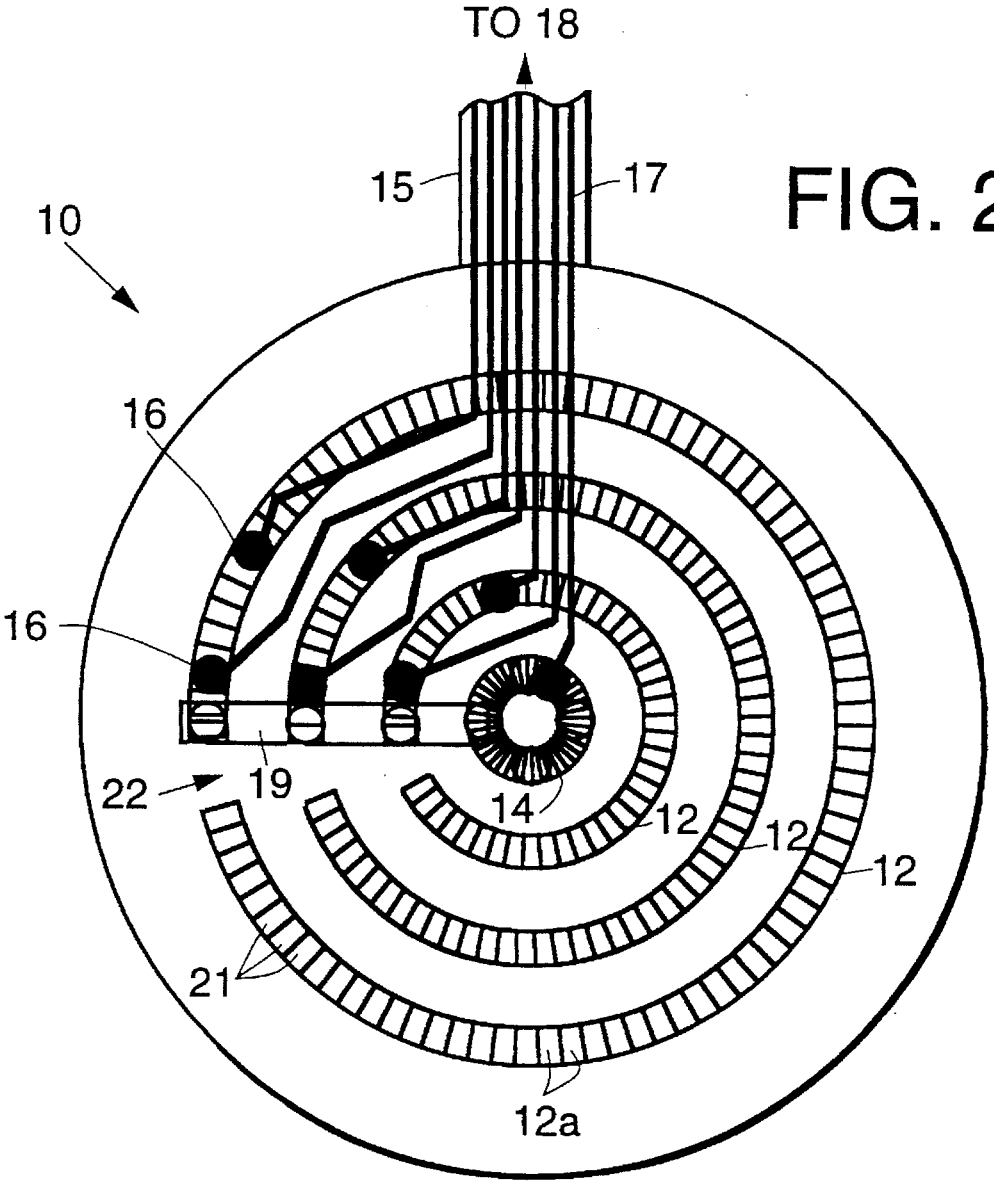
FIG. 2 is an enlarged superimposed view showing details of the components of the variable resistor shown in FIG. 1.

FIG. 2 is an enlarged superimposed view showing details of the components of the variable resistor 10 shown in FIG. 1. The ceramic substrate 11 is shown disposed below the flexprint circuit 15. As is more clearly illustrated in FIG. 2, the printed ink resistors 12 are each comprised of a plurality of individually printed resistor sections 21 each having the same or different predetermined resistive values. The individually printed resistor sections 21 are disposed adjacent to one another to form a circle having a gap 22, such that the resistors 12 are formed in the shape of a "C". One bump 16 or dimple 16 contacts the central conductive ring 14. Thereafter, pairs of bumps 16 or dimples 16 contact each of the printed ink resistors 12 and are separated by a predetermined angular extent. Two bumps 16 or dimples 16 contact each resistor 12 so that shorts do not occur when the ceramic substrate 11 is rotated through the gap 22.

It should be readily apparent from looking at FIG. 2 that rotating the ceramic substrate 11 relative to the flexprint circuit 15, such as in a counterclockwise direction, for example, changes the particular resistor sections 21 (and hence the amount of resistance) disposed between the conductive strip 19 and the bumps 16 or dimples 16 that are closest thereto. This changes the value of each of the printed ink resistors 12. Furthermore, it should also be evident that there are six different resistor values that may be selected in the exemplary variable resistor 10 shown in FIGS. 1 and 2. A return is provided by means of the trace 17 coupled to the central conductive ring 14. The six resistive values are provided by the resistance value taken between each of the respective bumps 16 or dimples 16 and the central conductive ring 14, depending upon the location of the conductive strip 19 relative to the gap 22 in the resistors 12.

Thus, the variable resistor 10 employs a bumped or dimpled flexprint circuit 15 that rotates relative to an adjacent ceramic substrate 11 having concentric circular resistors 12 formed with printed resistive ink 12*a*. The ceramic substrate 11 is fused or screened with the resistive ink 12*a* in a circular arrangement that forms the plurality of concentric printed resistors 12.

Figure 3:
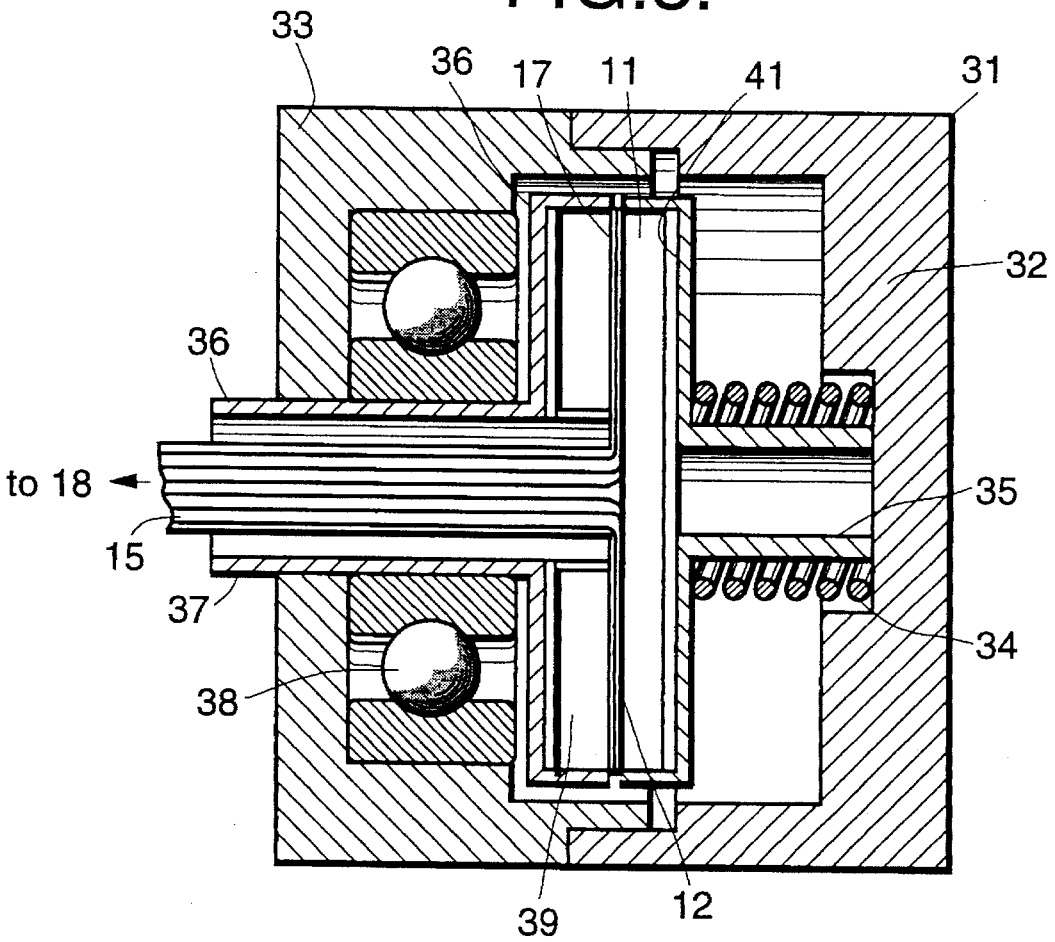
FIG. 3 is a cross sectional view of a fully assembled variable resistor.

Referring to FIG. 3, it illustrates a cross sectional view of a variable resistor 10. The variable resistor 10 includes a housing 31 that comprises first and second mating portions 32, 33. A spring 34 is centrally located in one portion of the housing and abuts a rear surface of a first metal holder 35 secured to the first portion of the housing 32 to which the ceramic substrate 11 is bonded by means of epoxy 41, for example. The plurality of concentric circular printed ink resistors 12 are disposed on the surface of the ceramic substrate 11 distal from the spring 34 and face the center of the housing 31. The flexprint circuit 15 is disposed adjacent to the ceramic substrate 11 and has its bumps (not shown) or dimples (not shown) made to contact the plurality of concentric circular printed ink resistors 12, and is bonded to a plate 39, which in turn is secured in a second metal holder 36 having a stem 37 that protrudes outside the housing 31. This permits a portion of the flexprint circuit 15 to extend outside the housing 31 through the stem 37 to allow connections to be made to the variable resistor 10. A bearing 38 is disposed between the second metal holder 36 and an inner wall of the second portion 33 of the housing 31 that permits rotation of the ceramic substrate 11 relative to the bumps or dimples of the flexprint circuit 15.

The present invention provides for a relatively low cost, reliable variable resistor 10, or potentiometer, for use in analog circuits. The variable resistor 10 may be produced at low cost due to the fact that it is inexpensive to print and fabricate the flexprint circuit 15 and printed ceramic substrate 12 when compared to conventional variable resistors. The variable resistor 10 has a low profile, low cost, low weight. In addition, a plurality of variable resistors 10 may be formed in the same device using the concepts of the present invention.

Thus there has been described a new and improved flow cost variable resistor made using flexprint circuits. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. A variable resistor comprising:

a ceramic substrate having a plurality of concentric circularly-shaped printed ink resistors disposed on one surface of the ceramic substrate;

a central conductive ring disposed at the center of the plurality of concentric conductive printed ink resistors;

a conductive strip interconnecting the conductive ring to one end of each of the concentric printed ink resistors;

a flexprint circuit having a plurality of contacts disposed on one surface of the flexprint circuit, and wherein the contacts are disposed adjacent to the printed ink resistors of the ceramic substrate;

a plurality of conductive traces disposed on an opposite surface of the flexprint circuit and connected to the plurality of contacts;

means for permitting rotation of the ceramic substrate relative to the flexprint circuit to thereby change the value of each of the printed ink resistors, wherein the means for permitting rotation comprises:

a housing;

a spring disposed in the housing that abuts a surface of the ceramic substrate distal from the printed ink resistors;

a bearing disposed between the flexprint circuit and a wall of the housing that permits rotation of the ceramic substrate relative to the contacts of the flexprint circuit.

2. The variable resistor of claim 1 wherein each of the printed ink resistors is printed so that it forms less than a complete circle such that there is a gap formed between adjacent ends thereof, so that the printed ink resistors thus are formed in the shape of a "C".

3. The variable resistor of claim 1 wherein the plurality of contacts comprise bumps.

4. The variable resistor of claim 1 wherein the plurality of contacts comprise dimples.

5. The variable resistor of claim 1 wherein the printed ink resistors are each comprised of a plurality of individually printed resistor sections each having a different predetermined resistive value.

6. The variable resistor of claim 1 wherein:

the housing comprises first and second mating portions;

the spring is disposed in one portion of the housing;

the bearing is disposed between the flexprint circuit and an inner wall of the second portion of the housing.

7. A variable resistor comprising;

a housing comprising first and second mating portions;

a ceramic substrate disposed in the first portion of the housing that comprises:

a plurality of concentric circularly-shaped printed ink resistors disposed on one surface of the ceramic substrate;

a central conductive ring disposed at the center of the plurality of concentric conductive printed ink resistors;

a conductive strip interconnecting the conductive ring to one end of each of the concentric printed ink resistors;

a flexprint circuit disposed in the second portion of the housing that comprises:

a plurality of contacts disposed on one surface of the flexprint circuit, and wherein the contacts are disposed adjacent to the printed ink resistors of the ceramic substrate;

a plurality of conductive traces disposed on an opposite surface of the flexprint circuit and connected to the plurality of contacts;

means for permitting rotation of the ceramic substrate relative to the flexprint circuit to thereby change the value of each of the printed ink resistors.

8. The variable resistor of claim 7 which further comprises a spring disposed in the first portion of the housing that abuts a rear surface of the ceramic substrate.

9. The variable resistor of claim 7 wherein the means for permitting rotation comprises a bearing disposed between the flexprint circuit and an inner wall of the second portion of the housing.

* * * * *